US005436707A

United States Patent [19]

Ogane et al.

[11] Patent Number: 5,436,707

[45] Date of Patent: Jul. 25, 1995

[54] PROCESS CARTRIDGE FOR USE IN IMAGE FORMING APPARATUS

[75] Inventors: Atsushi Ogane; Motoji Kawamoto, both of Hachioji, Japan

[73] Assignee: Konica Corporation, Tokyo, Japan

[21] Appl. No.: 249,444

[22] Filed: May 26, 1994

[30] Foreign Application Priority Data

Jun. 18, 1993 [JP] Japan ..... 5-147679

[51] Int. Cl.[6] ..... G03G 21/00

[52] U.S. Cl. ..... 355/260; 355/210; 355/221

[58] Field of Search ..... 355/260, 245, 200, 210, 355/211, 221, 296

[56] References Cited

U.S. PATENT DOCUMENTS 4,566,777 1/1986 Honda et al. .

5,260,750 11/1993 Ishida et al. ..... 355/260

FOREIGN PATENT DOCUMENTS 51-2433 1/1976 Japan .

60-130448 8/1985 Japan .

63-168451 11/1988 Japan .

*Primary Examiner*—R. L. Moses

*Attorney, Agent, or Firm*—Frishauf, Holtz, Goodman & Woodward

[57] ABSTRACT

A process cartridge is provided detachably mountable to and for use in an image forming apparatus. The process cartridge includes a charging unit, an exposure unit and a developing unit around a photoreceptor. A toner supply unit is integrally provided on the front side of the process cartridge. A toner accommodation casing is provided in the toner supply unit for accommodating toner. The toner accommodating casing composes a structural portion of the process cartridge.

3 Claims, 7 Drawing Sheets

PROCESS CARTRIDGE FOR USE IN IMAGE FORMING APPARATUS

BACKGROUND OF THE INVENTION

The present invention relates to an image forming apparatus such as an electrophotographic copier and laser printer, and more particularly relates to an image forming apparatus having a detachable process cartridge to which an image forming section including a photoreceptor, charging unit and developing unit, and a toner supply section are integrally assembled.

In general, an image forming apparatus such as an electrophotographic copier and laser printer is constructed as follows:

A photoreceptor drum is rotatably provided approximately at a center of the apparatus. Around the photoreceptor drum, there are successively provided a charging unit, exposing unit, developing unit, transfer unit, separation unit, cleaning unit, and discharging unit. In the above components, the photoreceptor drum, charging unit, developing unit and cleaning unit include parts of consumption, the lives of which are limited. Therefore, in order to maintain the quality of copied images, it is necessary to successively replace the parts with new ones . For this reason, a process cartridge is employed, in which the photoreceptor drum, charging unit, developing unit and cleaning unit are integrally accommodated in one casing. In the cases of inspection, repair and maintenance, the process cartridge is withdrawn from the apparatus body for the purpose of cleaning the photoreceptor, replacing the developer, cleaning the charging unit and replacing the cleaning member. After a predetermined number of images have been formed, the process cartridge is replaced with a new one.

To the developing unit described above, toner is supplied by a toner supply unit, which is disposed at a position close to the developing unit, that is, the toner supply unit is disposed at an upper position on the front side of the apparatus. In the case of an image forming apparatus in which images are formed at a middle or high speed, a relatively large amount of toner is accommodated in this toner supply unit. Therefore, a casing of the toner supply unit is constructed to be large and disposed on the front side of the charging unit in such a manner that the toner supply unit occupies the front side of the charging unit provided in an upper portion of the photoreceptor drum.

Toner powder, paper dust and solid oxide film tend to adhere to a discharging wire electrode which is provided in the charging unit. When the above adhering materials are accumulated on the electrode, electrical charges are not uniformly distributed, in other words, the intensity of the distributed electrical charge becomes uneven. Therefore, density of a copied image becomes uneven. For this reason, it is necessary to clean the wire discharging electrode at an appropriate time, and a discharging wire cleaning means is provided to fulfill this requirement.

Discharging wire cleaning means provided in the conventional charging unit will be described as follows.

(1) The process cartridge is completely detached from the image forming apparatus, and the cleaning member is manually operated so that the wire electrode can be cleaned.

(2) A toner supply unit disposed on the front side of the process cartridge is moved in a transverse or downward direction so that the front side of the charging unit can be opened, and then a handle of the cleaning member is held by an operator and the cleaning member is manually pulled out. Then the wire electrode is cleaned.

(3) According to Japanese Utility Model Publication Open to Public Inspection No. 168451/1988 applied by the present applicant, the toner supply unit is disposed at a position except for the front side of the charging unit. An operation handle of the discharging wire cleaning means penetrates a casing the image forming apparatus, so that the discharging wire can be cleaned by operating the handle from the outside of the apparatus.

In the case of item (1), it is necessary for an operator to take out the process cartridge from the image forming apparatus each time the discharging wire of the charging unit is cleaned. Accordingly, the operation property is remarkably lowered.

In the case of item (2), the structure to withdraw the toner supply unit is complicated, and further the operation property is not good.

In the case of item (3), the discharging wire cleaning member penetrates the casing. This structure is limited to a case in which the toner supply unit does not exist on the front side of the charging unit.

As disclosed in Japanese Patent Publication Open to Public Inspection No. 2433/1976, the photoreceptor drum, charging unit, developing unit, toner bottle and cleaner, which are components necessary for image formation, are integrated into one unit in a process cartridge, and each unit is positioned in the process cartridge in such a manner that each unit is fixed to a frame of the cartridge. In the above structure, the dimensions of the frame are increased, so that it is difficult to maintain the accuracy and rigidity of the parts, and in the case where a plurality of parts are used to compose the frame, the number of parts is increased, which raises the costs of the apparatus.

In an image forming apparatus to which a clam-shell type structure is adopted, it is common that a lock lever is operated when an upper body is opened, and a portion of the upper body is pressed by an operator when the upper body is closed. In the case disclosed in Japanese Utility Model Publication Open to Public Inspection No. 130448/1985, a handle exclusively used for opening and closing is provided. It is obvious that the operating property can be improved in the opening and closing operation of the upper body when the handle is provided. However, when the upper body is opened, it is necessary to release the lock. Therefore, the handle is indispensable. However, when the handle is used for closing the upper body, the handle is operated in an opposite direction, so that the structure becomes complicated. Further, when an exclusive handle is provided, the number of parts is increased, which raises the manufacturing cost.

SUMMARY OF THE INVENTION

The present invention has been achieved to solve the above problems. The present invention relates to improvements in an image forming apparatus in which a toner supply unit is integrally provided on the front side of the process cartridge. It is an object of the present invention to provide an image forming apparatus characterized in that: the discharging wire of the charging unit can be easily cleaned; the process cartridge having a toner supply container is made compact, so the accuracy and rigidity can be maintained; the upper body of the clam-shell type structure can be easily opened and closed; and the manufacturing cost of the apparatus is reduced.

In order to accomplish the above object, the first embodiment of the process cartridge of the present invention is constructed as follows. In the detachable process cartridge, around a photoreceptor drum, there is provided at least a charging unit having a discharging wire cleaning unit, and also there are provided an exposing unit and a developing unit. A toner supply unit is integrally provided on the front side of the process cartridge. A hollow member penetrating a toner accommodation casing of the toner supply unit is disposed and fixed in parallel with a discharging wire of the charging unit. At one end of a holding member sliding inside the hollow member, a discharging wire cleaning member is provided, and at the other end, a handle member for operation is provided.

In order to accomplish the above object, the second embodiment of the process cartridge of the present invention is constructed as follows. In a detachable process cartridge, around the photoreceptor drum, there are provided at least a charging unit, exposing unit, and developing unit. A toner supply unit is integrally provided on the front side of the process cartridge. A toner accommodation casing of the toner supply unit composes a surface of the structure of the process cartridge.

In order to accomplish the above object, the third embodiment of the process cartridge of the present invention is constructed as follows. In a detachable process cartridge of the clam-shell type image forming apparatus in which an upper body is opened and closed with respect to a lower body, there are at least provided a charging unit, exposing unit and developing unit around a photoreceptor drum. A toner supply unit is integrally provided on the front side of the process cartridge. A manual press member for pressing the upper body against the lower body is provided in the toner supply unit so that the upper body is locked with the lower body.

DETAILED DESCRIPTION OF THE PREFERRED EMBODIMENTS

With reference to the accompanying drawings, an embodiment of the process cartridge of the image forming apparatus of the present invention will be explained as follows.

Figure 1:
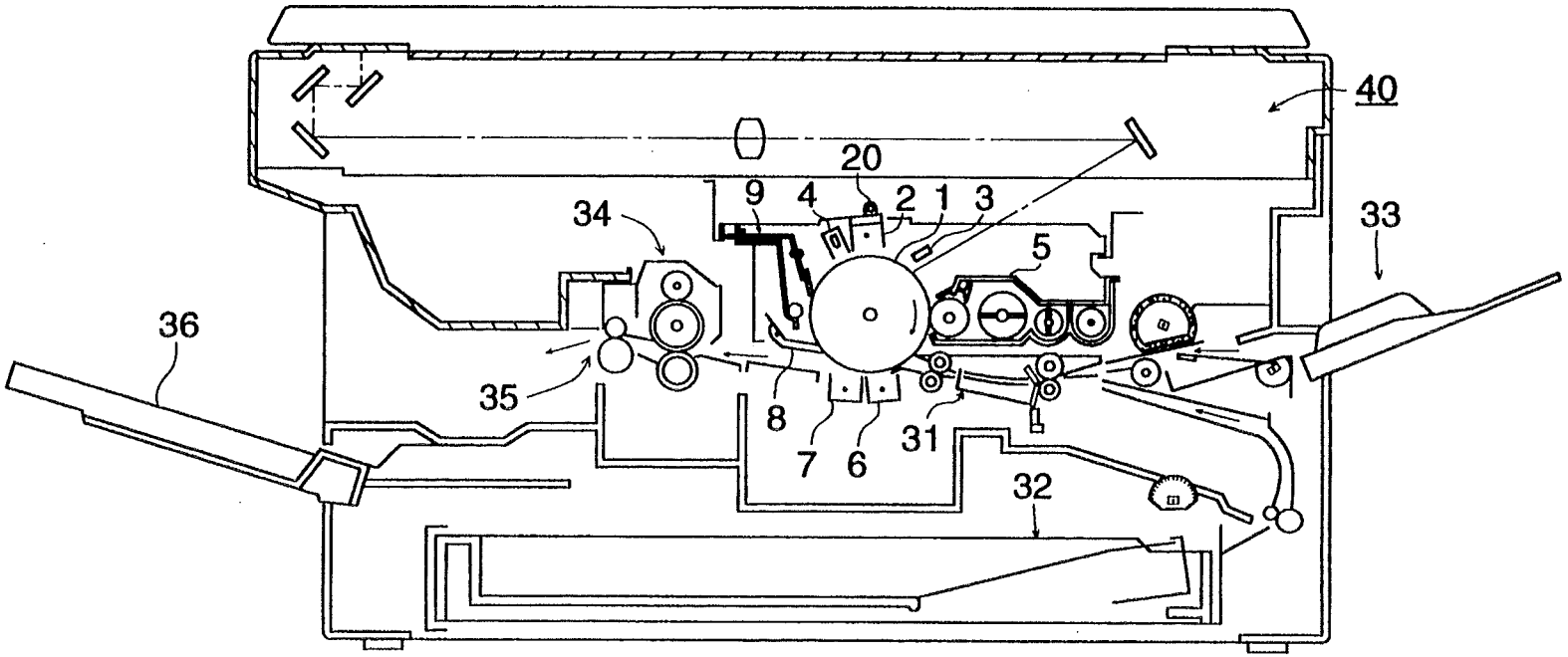
FIG. 1 is a sectional front view of the image forming apparatus according to the present invention.

FIG. 1 is a sectional front view of the copier which is an example of the image forming apparatus of the present invention.

As shown in FIG. 1, approximately at the center of the drawing, there is provided a rotatable photoreceptor drum 1. On the upside of the photoreceptor drum 1, a charging unit 2, black frame removing discharging member 3 and discharging light source 4 are provided around the photoreceptor 1. On the right side of the photoreceptor drum 1, there is provided a developing unit 5. On the lower side of the photoreceptor drum 1, there are provided a transfer unit 6, separation unit 7 and separating claw 8. On the left side of the photoreceptor drum 1, there is provided a cleaning unit 9. In FIG. 1, numeral 40 is a document exposing scanning section by which a document image is projected on a circumferential surface of the photoreceptor drum 1 so that a latent image can be formed.

An intermediate sheet supply means 31 composed of a pair of rollers is disposed at a lower position of the developing unit 5. In this case, recording sheets are supplied from a sheet feed cassette 32 disposed at a lower position of the image forming apparatus, or supplied from a manual sheet feed means 33 disposed on the right of the apparatus. Then the sheets are conveyed by the intermediate sheet feed means 31 to a transfer section in a timed relation.

A fixing unit 34 and sheet discharging means 35 are provided on the downstream side of the separation unit 7. Images formed on a recording sheet are fixed by the fixing unit 34, and then the recording sheet is discharged onto a sheet discharge tray 36.

Figure 2:
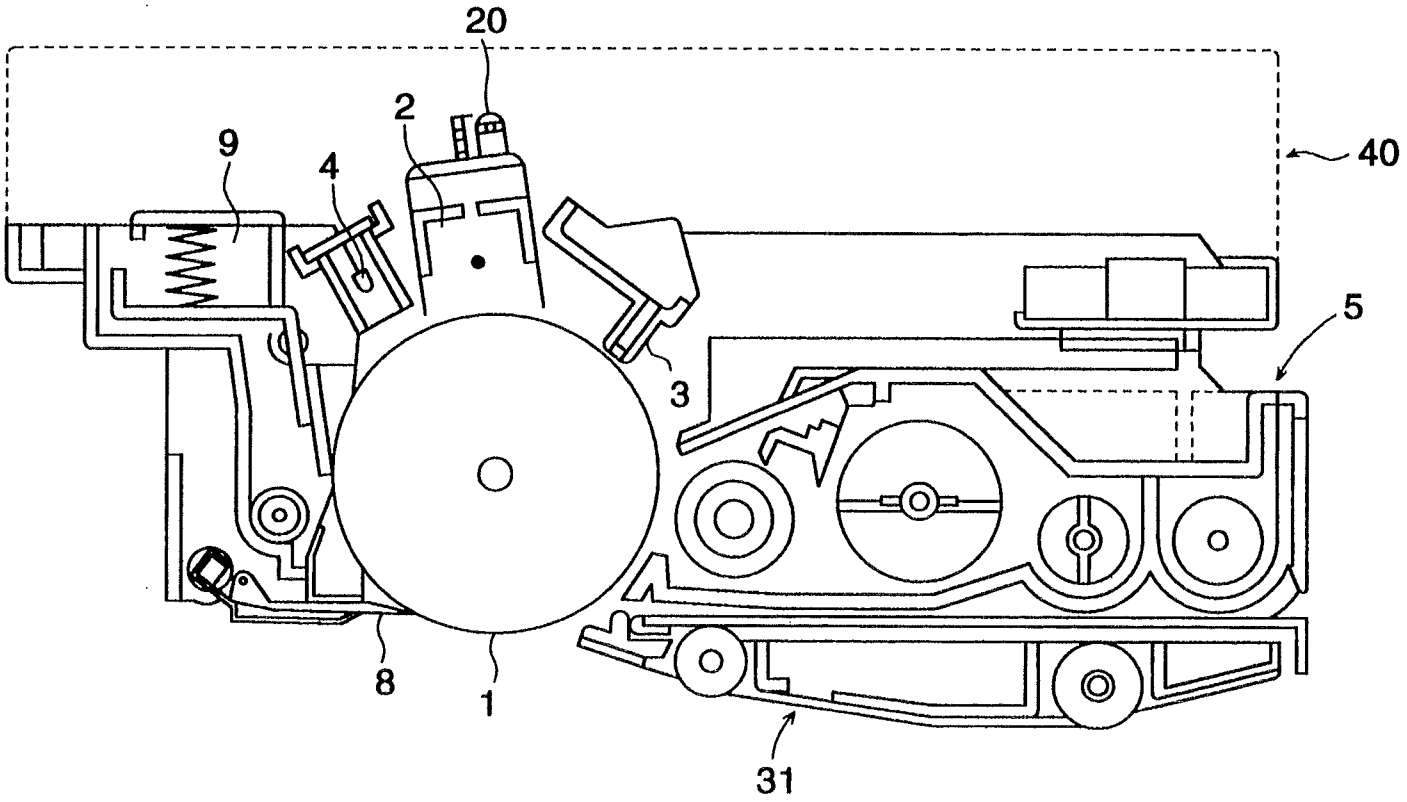
FIG. 2 is a sectional front view of the process cartridge provided to the image forming apparatus.
Figure 3:
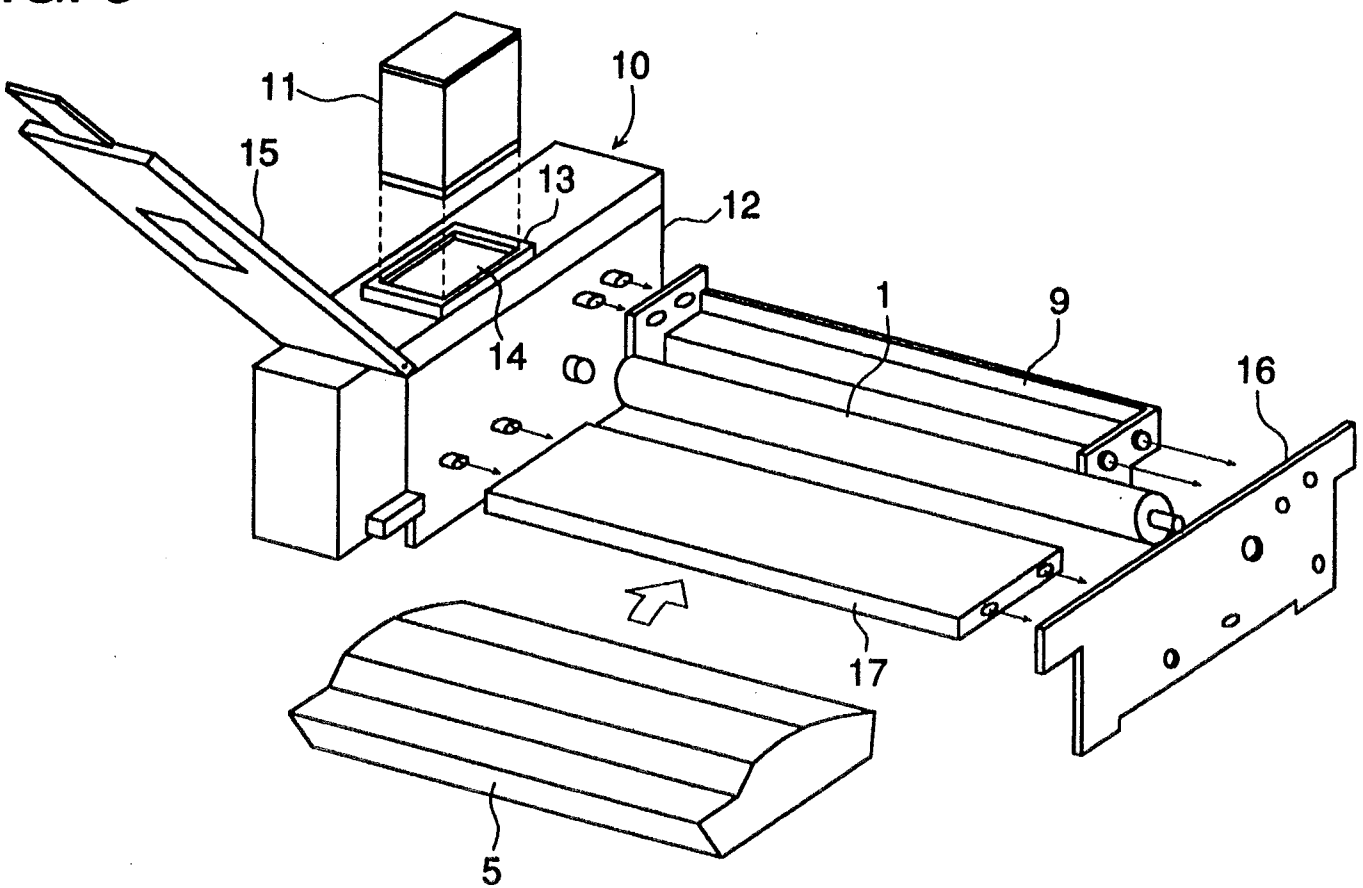
FIG. 3 is an exploded perspective view of the process cartridge.

FIG. 2 is a sectional front view of the process cartridge provided to the image forming apparatus, and FIG. 3 is an exploded perspective view of the process cartridge. The process cartridge includes the charging unit 2, black frame removing discharging member 3, developing unit 5, idle rollers of the intermediate sheet feed means 31, separation claw 8, cleaning unit 9 and discharging light source 4, which are successively disposed around the photoreceptor drum 1 in the rotational direction.

A toner supply unit 10 is disposed on the front side of the process cartridge. In a casing 12 of the toner supply unit 10, a predetermined amount of toner is accommodated. The accommodated toner is sent to the developing unit 5 by the action of a toner conveyance screw 18 (shown in FIG. 4) provided in the casing 12.

In an upper portion of the casing 12, a mount portion 13 is provided, by which the toner supply container 11 is attached to or detached from the toner supply unit 10. A movable cover 14 is provided in the mount portion 13, and a shielding cover member 15, which is pivotally supported, is also provided. When the toner supply container 11 is not attached to the toner supply unit 10, the upper portion of the casing 12 is closed by the shielding cover member 15.

By the action of the shielding cover member 15, toner scattered around the mount portion 13 and movable cover 14 can be prevented from further scattering outside, that is, scattered toner is closed in the upper portion of the casing 12, so that the operator is not affected by the scattered toner.

When an upper surface of the shielding cover member 15 is pressed by the operator with fingers under the condition that the shielding cover member 15 has been closed, an upper portion of the copier to which the casing 12 is integrally assembled is pressed downward, and the upper portion is locked to a lower portion the copier. In this way, the copier is ready for copying operation.

A toner discharge port and shutter, which are not shown in the drawing, are provided in a lower portion of the casing 12, so that toner can be supplied to the developing unit 5 through the toner discharge port and shutter.

The casing 12 composes a portion of the structure of the process cartridge. The structure of the process cartridge includes the casing 12, rear panel 16, and a plurality of stay plates 17, so that the process cartridge is composed of a strong frame. Image forming units including the photoreceptor drum 1, charging unit 2, developing unit 5, cleaning unit 9 and others are assembled to the structure.

Figure 4:
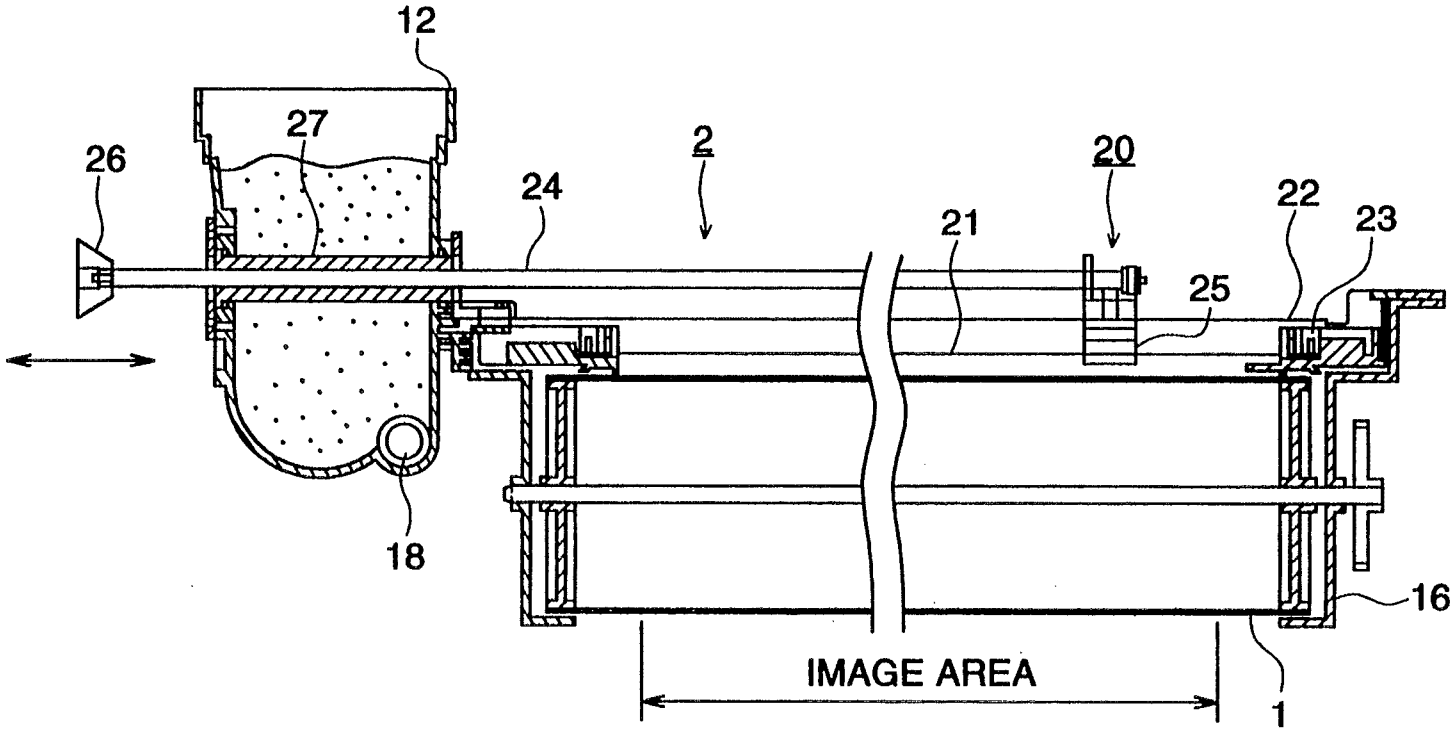
FIG. 4 is a longitudinal sectional view of the front surface of the process cartridge.

FIG. 4 is a longitudinal sectional view of the front surface of the process cartridge.

As illustrated in the drawing, the photoreceptor drum 1 is supported by a structure composed of the casing 12 of the toner supply unit 10 and the rear panel 16. The charging unit 2 is disposed above the photoreceptor drum 1.

The charging unit 2 is composed of a discharging wire 21, back plate 22 and holding frame 23. The discharging wire cleaning unit 20 is composed of a holding member 24, cleaning member 25, and operation handle 26. The discharging wire cleaning unit 20 is disposed above the charging unit 2. A portion of the discharging wire cleaning unit 20 penetrates the casing 12 of the toner supply unit 10. In an upper portion of the back plate 22, a long and slender rod-shaped discharging wire cleaning holding member 24 is supported so that the member 24 can be moved in parallel with the discharging wire 21. A cleaning member 25 made of felt is attached to one end of the holding member 24 in such a manner that the cleaning member 25 can be contacted with and separated from the discharging wire 21. An operation handle 26 is fixed to the other end of the holding member 24.

The holding member 24 penetrates approximately at the center of the casing 12 of the toner supply unit 10, and the operation handle 26 protrudes from the casing 12 on the front side of process cartridge. The holding member 24 is inserted into a hollow member 27 provided between the walls of the casing 12 approximately at the center. Therefore, the holding member 24 is capable of sliding on the inner surface of the hollow member 27.

In the case of cleaning the discharging wire 21, the operation handle 26 is pulled to the operators side. When the handle has reached the stop position, the handle 26 is pushed into the hollow member 27 so that the handle 26 returns to the initial position. When the handle 26 is once reciprocated, the cleaning member 25 holds the discharging wire 21 and removes toner powder, paper dust and solid oxide films from the surface of the discharging wire 21.

Figure 5:
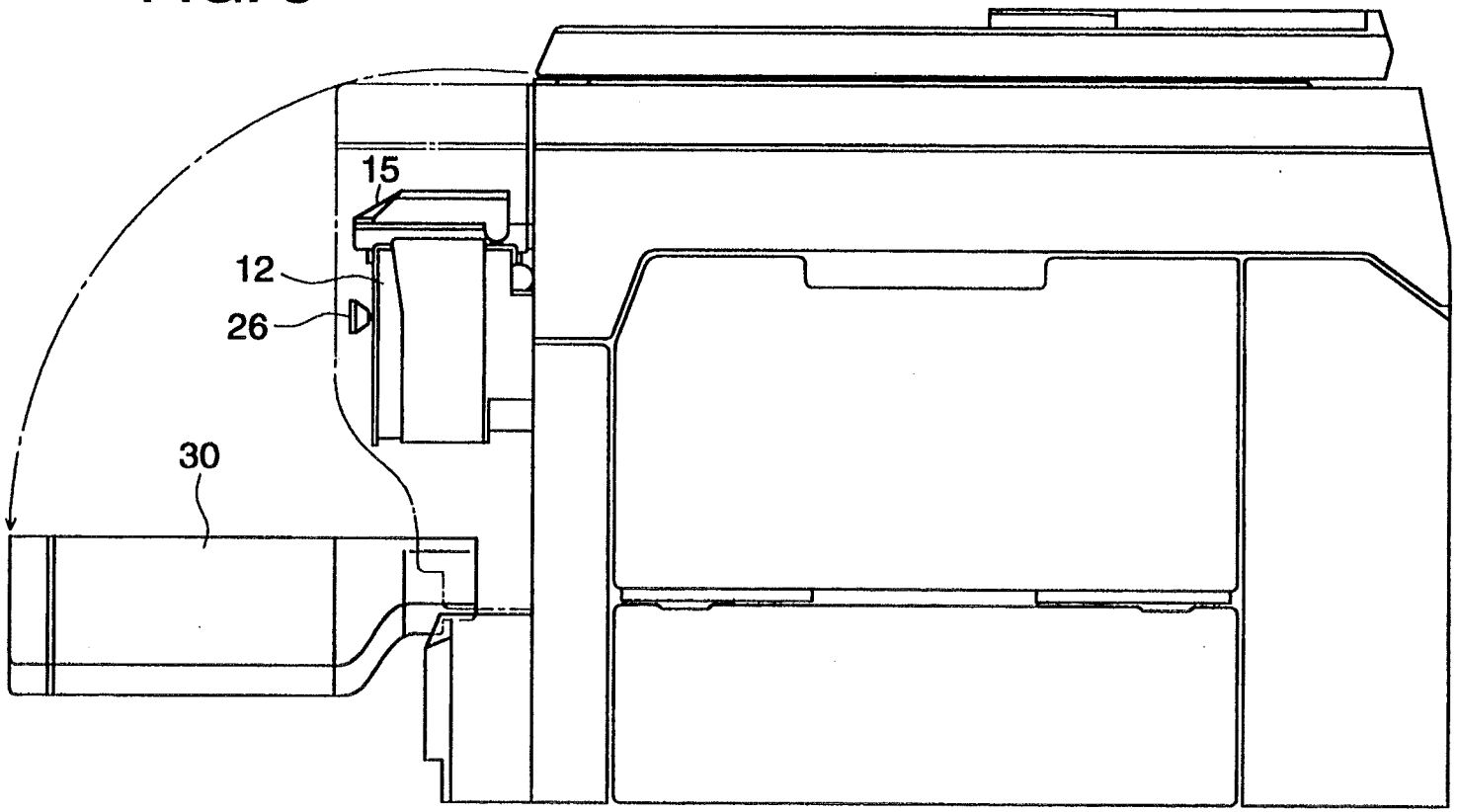
FIG. 5 is a right side view showing a condition in which the front door of the image forming apparatus is opened.
Figure 6:
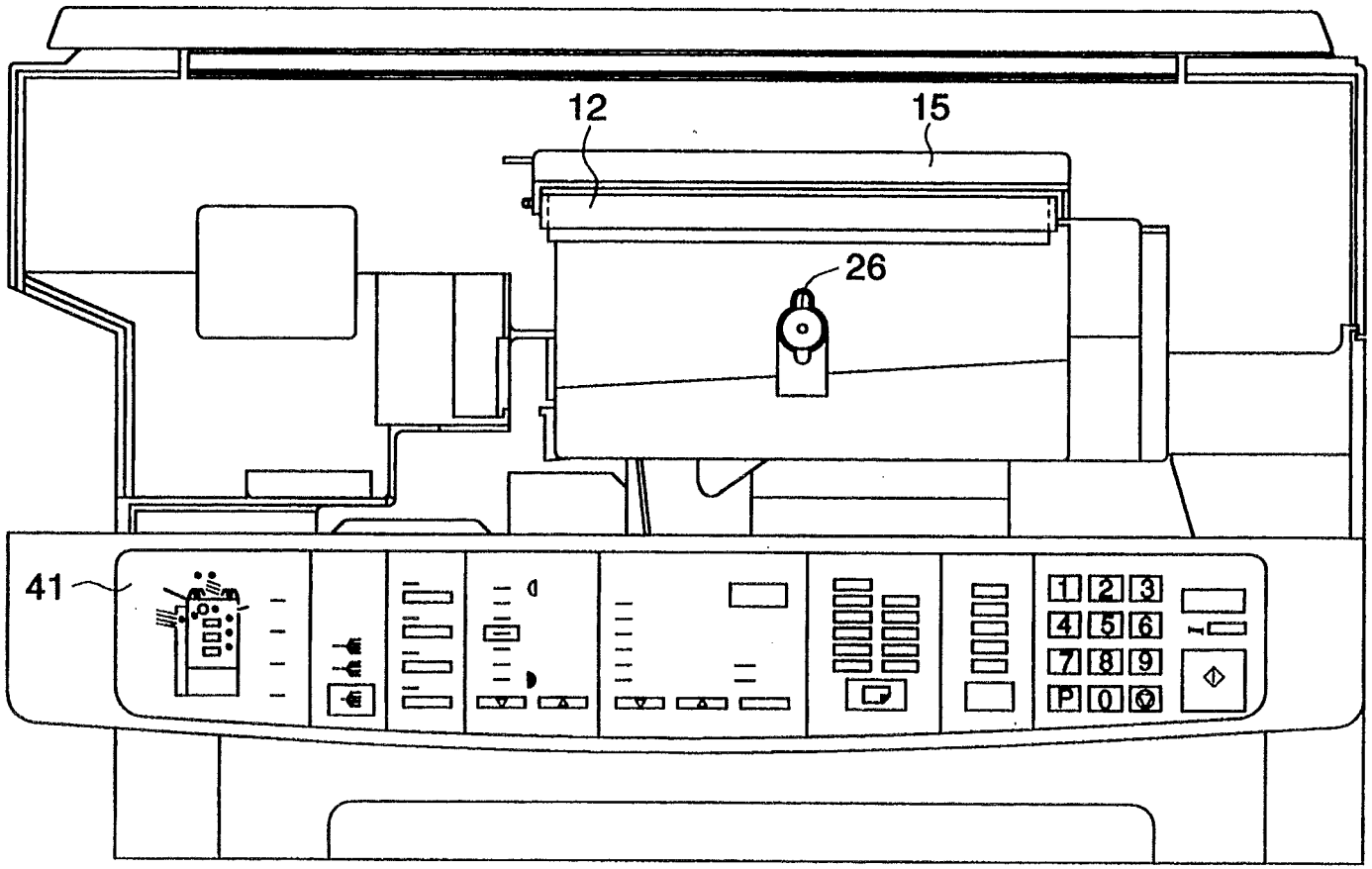
FIG. 6 is a front view of the image forming apparatus under condition that the front door is opened.

FIG. 5 is a right side view showing a condition in which a front door of the image forming apparatus of the present invention is opened. In FIG. 5, the front door 30 is opened to the front side, so that the front side of the image forming apparatus is in an open condition. FIG. 6 is a front view of the image forming apparatus, the front side of which is opened.

When the front door 30 is open, the toner supply unit 10 and operation handle 26 for discharging wire cleaning are exposed. Under the open condition, the operation handle 26 is pulled to the front side. When the operation handle 26 has reached the stop position, it is pushed back and returned to the initial position. Due to the foregoing reciprocating motion, the discharging wire 21 in the charging unit 2 is cleaned by the cleaning member 25. In this connection, reference numeral 41 shown in FIG. 6 is an operation panel.

Figure 7:
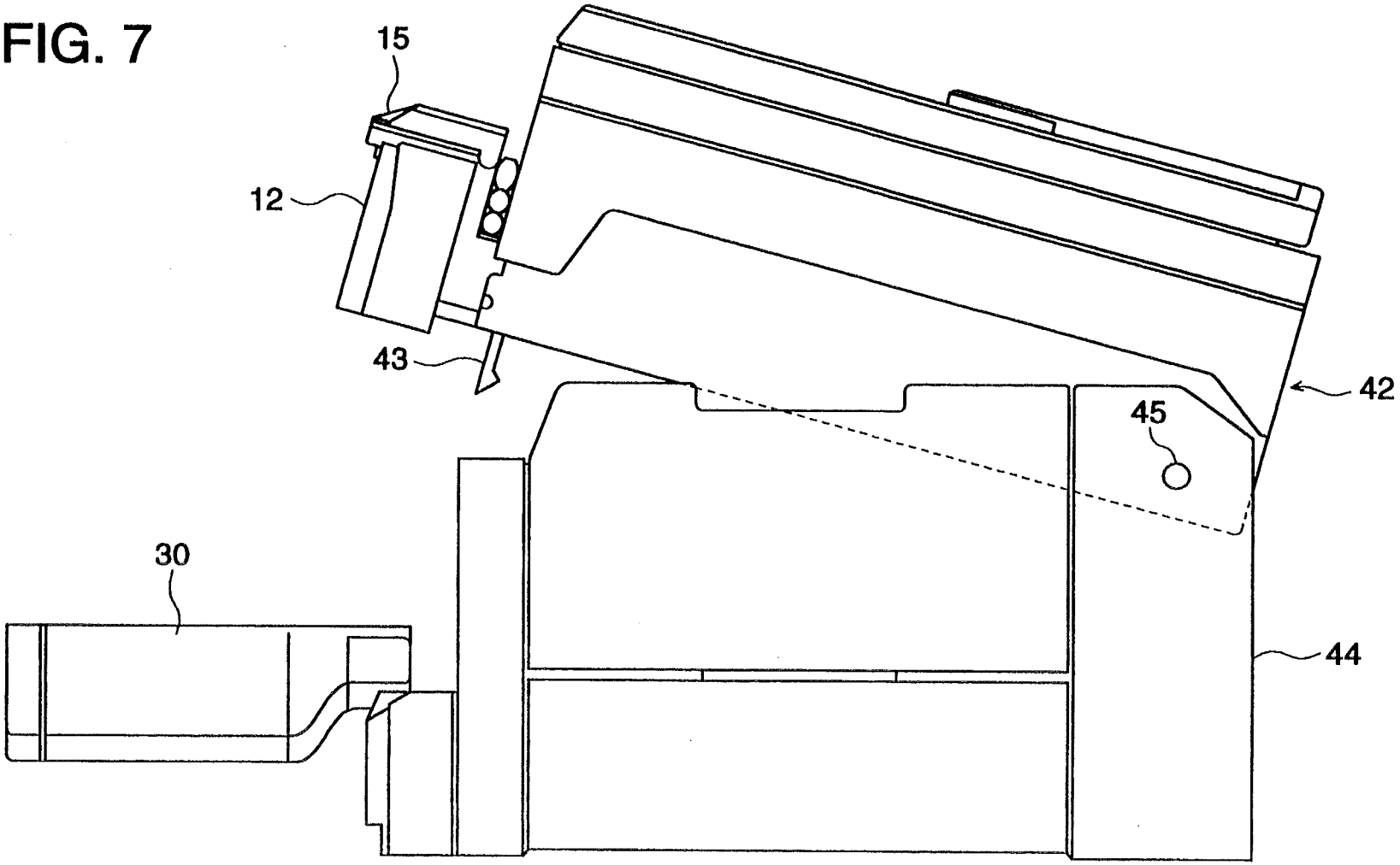
FIG. 7 is a right side view of the clam-shell type image forming apparatus which has been opened.

FIG. 7 is a right side view of the clam-shell type image forming apparatus of the present invention, wherein the image forming apparatus is in an open condition.

In order to open the image forming apparatus as illustrated in FIG. 7, the operation is conducted as follows: First, the front door 30 is opened to the front side as described before, and an operation lever not shown is operated. Then an engaging claw 43 of the upper body 42 is disengaged from an engaging hole of the lower body 44, so that the engagement is released. Then, the upper body 42 is rotated around a pivotal shaft 45 by the action of a spring, so that the upper body 42 is rotated upward. In this way, the upper body 42 is opened as shown in FIG. 7. Under the above open condition, a recording sheet conveyance passage is divided and opened. Therefore, jam clearance can be performed under the above condition.

In order to close the upper body 42 under the above open condition, the shielding cover 15 in the upper portion of the toner supply unit 10 is pushed downward by the operator with his hand. Then, the engaging claw 43 of the upper body 42 is engaged with the engaging hole of the lower body 44 so that the upper and lower bodies are integrated into one body. After that, the front door 30 is closed. Then the apparatus is ready for the next copy operation.

The process cartridge of the image forming apparatus of the present invention is constructed in the manner described above. In the process cartridge, the operation handle is protruded to the front side from the toner supply unit provided on the front side of the process cartridge. When the operation handle is operated, the discharging wire of the charging unit can be easily cleaned, and this operation can be manually performed by the operator on the front side of the apparatus.

The toner supply unit functions as a component of the structure of the process cartridge. Accordingly, the number of parts of the structure can be reduced, and the accuracy and rigidity of the structure can be effectively improved.

When the cover is provided in the toner supply unit, toner is prevented from scattering outside after the supply of toner. Therefore, the apparatus can be maintained clean at all times. In order to close the upper body of a clam-shell type image forming apparatus, when the upper surface of the cover is pushed by the operator, the upper body can be easily returned to the original position and positively locked with the lower body.

What is claimed is:

1. A process cartridge detachably mountable to and for use in an image forming apparatus, in which at least a charging unit, an exposure unit and a developing unit are provided around a photoreceptor, said process cartridge comprising:

(a) a toner supply unit integrally provided on a front side of said process cartridge; and (b) a toner accommodation casing provided in said toner supply unit, for accommodating toner, said casing comprising a structural portion of said process cartridge.

2. A process cartridge detachably mountable to and for use in an image forming apparatus, in which at least a charging unit having a discharging wire cleaning unit for cleaning a discharging wire disposed inside said charging unit, an exposure unit and a developing unit are provided around a photoreceptor, said process cartridge comprising:

(a) a toner supply unit integrally provided on a front side of said process cartridge;

(b) a toner accommodation casing provided in said toner supply unit, for accommodating toner;

(c) a hollow member disposed to penetrate an inside of and fixed to said toner accommodation casing in parallel with a stretching direction of said discharging wire, said hollow member having a sliding surface inside thereof; and (d) said discharging wire cleaning unit comprising;

(1) a holding member provided to slide on said sliding surface of said hollow member, (2) a discharging wire cleaning member provided at one end of said holding member, for cleaning said discharging wire, and (3) a handle provided at the other end of said holding member, wherein when said holding member is slid through said handle, said discharging wire is cleaned by said discharging wire cleaning member.

3. A process cartridge detachably mountable to and for use in a clam-shell type image forming apparatus in which an upper body is opened and closed with respect to a lower body, said process cartridge having at least a charging unit, an exposure unit and a developing unit provided around a photoreceptor, said process cartridge comprising:

(a) a toner supply unit integrally provided on a front side of said process cartridge; and (b) a manual press member provided on said toner supply unit, wherein when said manual press member is manually pressed downwardly, said upper body is closed to said lower body to lock.

* * * * *